US008851782B2

(12) United States Patent
Pei

(10) Patent No.: US 8,851,782 B2
(45) Date of Patent: Oct. 7, 2014

(54) BRUSH HAVING STORAGE BAG

(71) Applicant: Hon Hai Precision Industry Co., Ltd., New Taipei (TW)

(72) Inventor: Shao-Kai Pei, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/869,901

(22) Filed: Apr. 24, 2013

(65) Prior Publication Data

US 2014/0130279 A1 May 15, 2014

(30) Foreign Application Priority Data

Nov. 15, 2012 (TW) ..... 101142574 A

(51) Int. Cl.
*A46B 11/04* (2006.01)
*A46B 9/04* (2006.01)
*A46B 15/00* (2006.01)

(52) U.S. Cl.
CPC ..... *A46B 15/0091* (2013.01); *A46B 9/04* (2013.01)
USPC ..... 401/282; 401/270; 401/152; 401/155; 401/176

(58) Field of Classification Search
CPC .... A46B 11/00; A46B 11/001; A46B 11/002; A46B 11/0024; A46B 11/0034; A46B 11/0037; A46B 11/0041; A46B 11/0044; A46B 11/0055; B05C 17/00576; B05C 17/00583; B05C 17/01; B05C 17/0116; B05C 17/012
USPC ..... 401/155, 152, 153, 156, 158, 163, 171, 401/176, 270, 282, 286, 291
See application file for complete search history.

(56) References Cited

U.S. PATENT DOCUMENTS 3,417,762 A * 12/1968 Hall ..... 401/176
4,116,570 A * 9/1978 Parenti ..... 401/155
4,826,341 A * 5/1989 Kwak ..... 401/280
5,464,294 A * 11/1995 Chee et al. ..... 401/269

* cited by examiner

*Primary Examiner* — David Walczak
(74) *Attorney, Agent, or Firm* — Novak Druce Connolly Bove + Quigg LLP

(57) ABSTRACT

A brush includes a substrate, a number of brush bristles, a storage bag, and a pushing element. The substrate includes a main body and a handle extending from the main body. The main body has a first loading surface supporting the brush bristles. The first loading surface defines a through hole. The main body defines a first receiving groove communicating with the though hole. The handle has a second loading surface, and defines a second receiving groove communicating with the first receiving groove. The second receiving groove passes through a portion of the second loading surface adjacent to the first receiving groove. The storage bag receives paste, and is received in the second receiving groove and partially extends into the first receiving groove to communicate with the through hole. The pushing element squeezes the storage bag to make the paste flow into gaps between the brush bristles.

5 Claims, 4 Drawing Sheets

BRUSH HAVING STORAGE BAG

BACKGROUND

1. Technical Field

The present disclosure relates to brushes, and particularly to a brush having a storage bag.

2. Description of Related Art

Brushes, for example, a tooth brush, are usually separated from its corresponding storage bag for storing toothpaste. Therefore, users will often forget to carry the storage bag, which is very inconvenient.

Therefore, it is desirable to provide a brush that can overcome the above-mentioned limitations.

BRIEF DESCRIPTION OF THE DRAWINGS

Many aspects of the embodiments should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
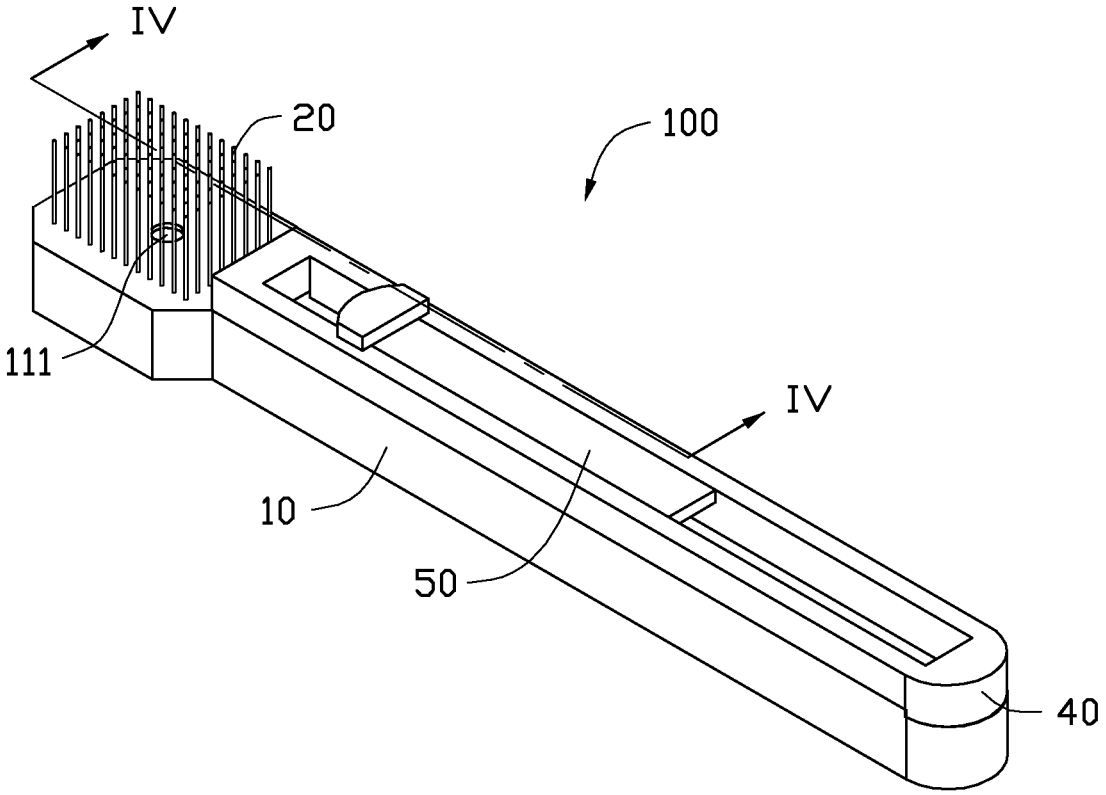
FIG. 1 is a schematic view of a brush, according to an exemplary embodiment.
Figure 2:
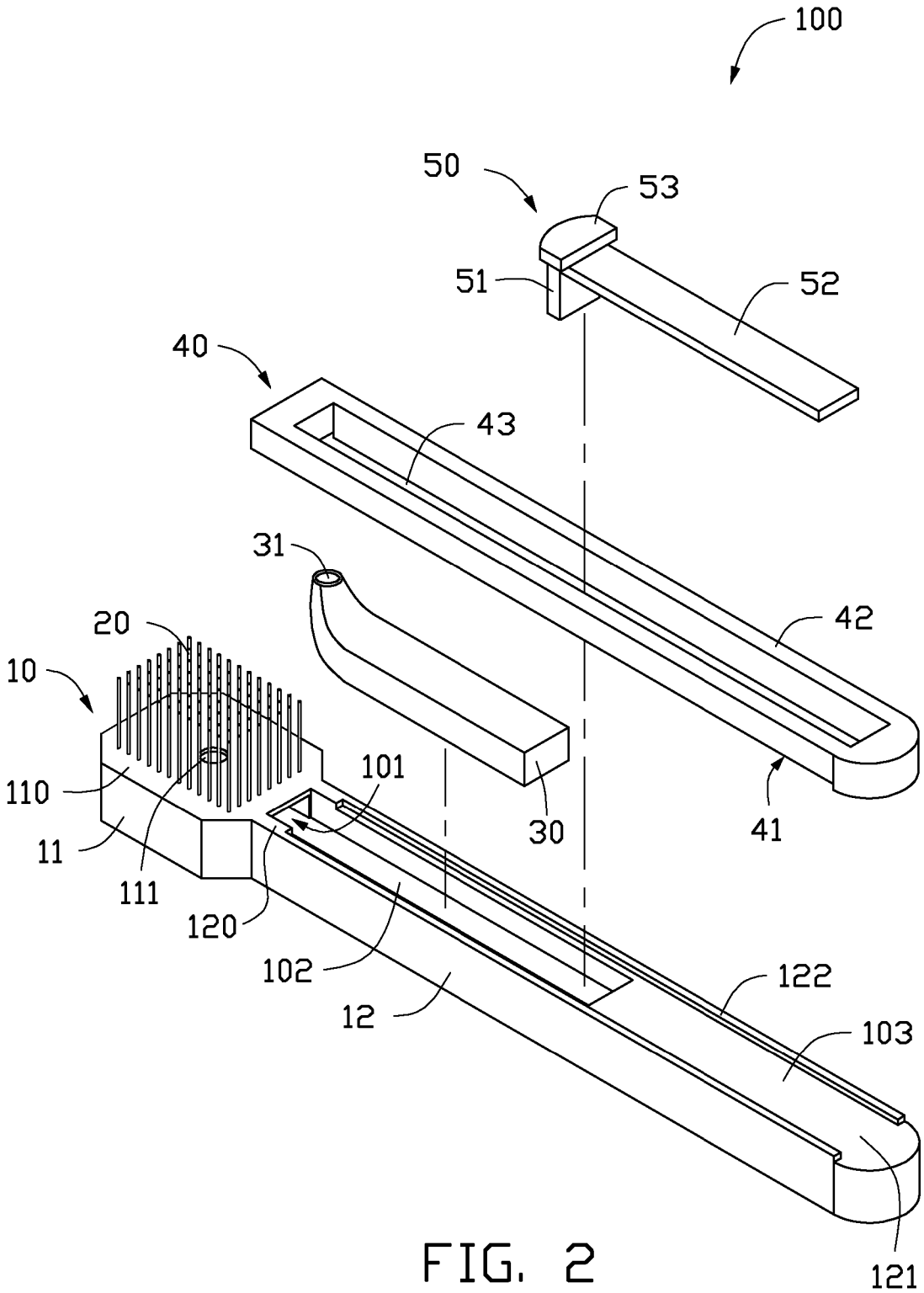
FIG. 2 is a schematic, exploded view of the brush of FIG. 1.

FIG. 1 and FIG. 2 illustrate a brush 100 in accordance with an embodiment. The brush 100 includes a substrate 10, a number of brush bristles 20, a storage bag 30, a fixing plate 40, and a pushing element 50.

The substrate 10 includes a main body 11 and a handle 12 extending from the main body 11. The main body 11 has a first loading surface 110. The handle 12 has a second loading surface 120. In the embodiment, the first loading surface 110 is coplanar with the second loading surface 120. The first loading surface 110 defines a through hole 111. The brush bristles 20 are fixed to the first loading surface 110. The second loading surface 120 defines a slot 121 extending along a lengthwise direction of the handle 12. The slot 121 includes two opposite sidewalls 122 and a bottom wall 103. In the embodiment, the brush bristles 20 are made of nanophase materials.

The main body 11 defines a first receiving groove 101 communicating with the through hole 111. The handle 12 defines a second receiving groove 102 extending along the lengthwise direction of the slot 121 and communicating with the first receiving groove 101. The second receiving groove 102 passes through the second loading surface 120, and passes through a portion of the bottom wall 103 adjacent to the main body 11.

The storage bag 30 is used for storing paste 200 (referring to FIG. 4, such as toothpaste), and has an opening 31. The storage bag 30 is received in the second receiving groove 102, and extends into the first receiving groove 101 to align the opening 31 with the through hole 11. When the storage bag 30 is squeezed, the paste 200 flows into the gaps between the brush bristles 20.

Figure 3:
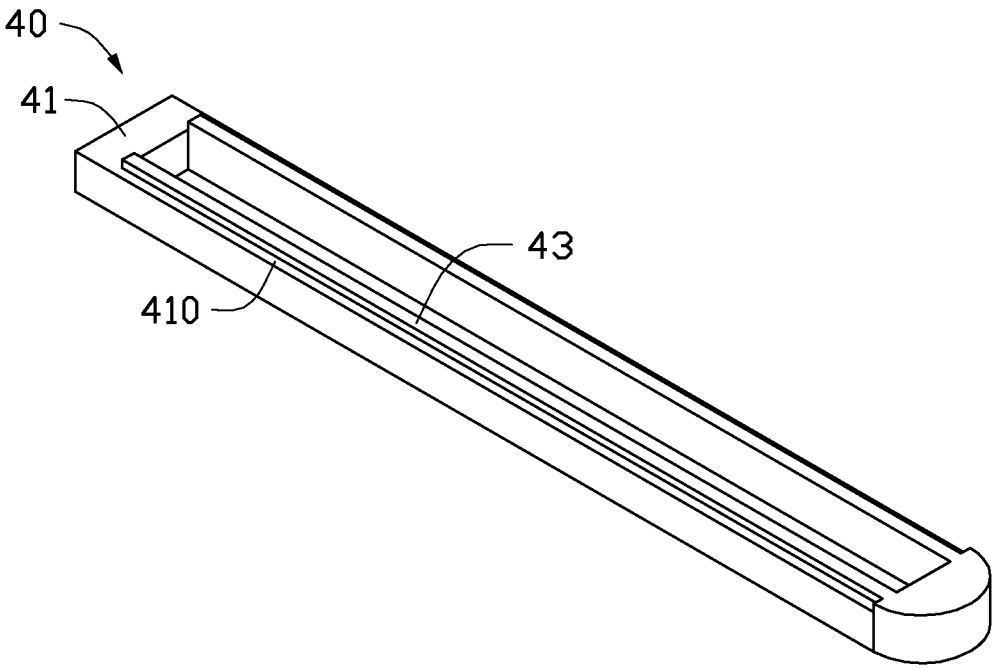
FIG. 3 is a schematic view of a fixing plate of the brush of FIG. 1.

The fixing plate 40 is substantially rectangular, and is positioned on the second loading surface 120. Also referring to FIG. 3, the fixing plate 40 includes a connecting surface 41 facing the second loading surface 120, and a supporting surface 42 opposite to the connecting surface 41. The fixing plate 40 defines a sliding groove 43 extending along a lengthwise direction of the fixing plate 40 and passing through the connecting surface 41 and the supporting surface 42. The length of the sliding groove 43 is greater than the length of the second receiving groove 102. The connecting surface 41 defines two parallel notches 410 corresponding to the two sidewalls 122 in shape and position. The two notches 410 are fit with the two sidewalls 122 respectively. The sliding groove 43 is aligned with the second receiving groove 102 when the two sidewalls 122 are received in the two notches 410 respectively.

Figure 4:
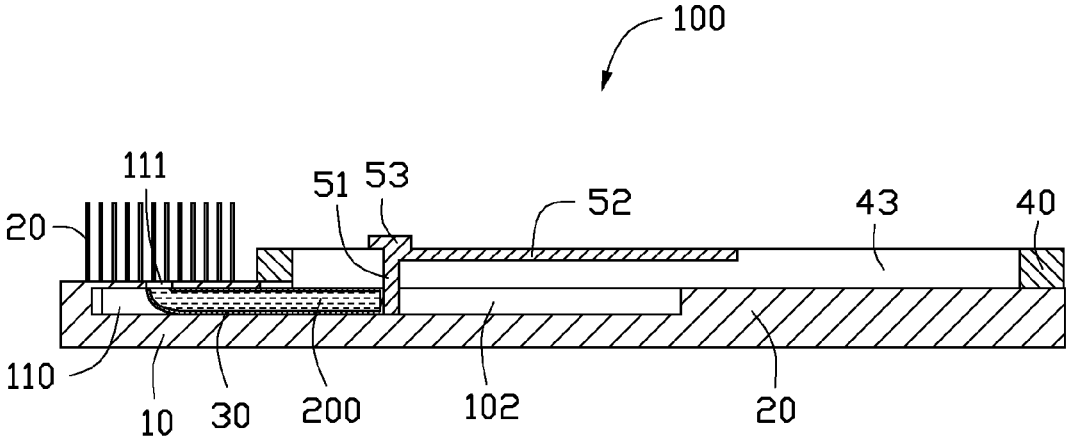
FIG. 4 is a cross-sectional view of the brush taken along a line IV-IV of FIG. 1.

Also referring to FIG. 4, the pushing element 50 includes a baffle 51, a locating plate 52, and a pushing plate 53. The baffle 51 is inserted into the second receiving groove 102 to squeeze the storage bag 30. The locating plate 52 is substantially perpendicular to the baffle 51, and is received in the sliding groove 43. Along a direction perpendicular to the extending direction of the sliding groove 43, the width of the locating plate 52 is a fit with the width of the sliding groove 43, and thus the locating plate 52 can be exactly engaged with the sliding groove 43, and the baffle 51 can steadily move in the second receiving groove 102. The pushing plate 53 is connected to the baffle 51 and the locating plate 52, and is positioned on the supporting surface 42, and thus the pushing plate 53 can drive the baffle 51 to move in the second receiving groove 102.

In use, when the pushing plate 53 is pushed, the baffle 51 moves along the second receiving groove 102 to squeeze the storage bag 30, thus the paste 200 flows into the gaps between the brush bristles 20, the user can use the brush bristles 20. When the paste has been used out, the user can push the pushing element 50 to make the paste 200 flow into the gaps between the brush bristles 20 again.

By employing the brush 100, the brush bristles 20 and the paste 200 are combined together, therefore, it is very convenient for users.

In other embodiments, the fixing plate 40 and the two sidewalls 122 also can be omitted, and the pushing element 50 is directly positioned on the second loading surface 120.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A brush, comprising:

a plurality of brush bristles;

a substrate comprising:

a main body having a first loading surface supporting the brush bristles, the first loading surface defining a through hole, and the main body defining a first receiving groove communicating with the though hole; and a handle extending from the main body, and defining a second receiving groove communicating with the first receiving groove, wherein the handle has a second loading surface, the second receiving groove passes through a portion of the second loading surface adjacent to the first receiving groove;

a storage bag for receiving paste, the storage bag received in the second receiving groove and partially extending into the first receiving groove to communicate with the through hole;

a pushing element comprising a baffle inserted in the second receiving groove, wherein the storage bag is squeezed by the baffle when the baffle is moved in the second receiving groove towards the first receiving groove, and thus the main body is adapted for a flow of paste from the storage bag and through the through hole into gaps between the brush bristles; and a fixing plate positioned on the second loading surface, the fixing plate comprising a connecting surface facing the second loading surface and a supporting surface opposite to the connecting surface, the fixing plate defining a sliding groove passing through the connecting surface and the supporting surface, a length of the sliding groove greater than a length of the second receiving groove, the baffle passing through the sliding groove to be received in the second receiving groove, and the pushing element comprising a pushing plate positioned on the supporting surface.

2. The brush of claim 1, wherein the first loading surface is coplanar with the second loading surface.

3. The brush of claim 1, wherein the second loading surface defines a slot extending along a lengthwise direction of the handle, the slot has two opposite sidewalls and a bottom wall, the two sidewalls are substantially parallel to each other, the second receiving groove passes through a portion of the bottom wall, the connecting surface defines two notches corresponding to the two sidewalls in shape and position, the two sidewalls are received in the corresponding notches, and thus the sliding groove is aligned with the second receiving groove.

4. The brush of claim 1, wherein the pushing element comprises a locating plate perpendicular to the baffle, the pushing plate connects the baffle and the locating plate, along a direction perpendicular to a extending direction of the slot, a width of the locating plate is substantially equal to a width of the sliding groove.

5. The brush of claim 1, wherein the brush bristles are made of nanophase material.

* * * * *